US006409262B1

(12) United States Patent
LaPointe

(10) Patent No.: US 6,409,262 B1
(45) **Date of Patent: *Jun. 25, 2002**

(54) ALL-LINKAGE RECLINING CHAIR WITH IMPROVED TENSIONING MECHANISM

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/543,431

(22) Filed: Apr. 5, 2000

Related U.S. Application Data

(63) Continuation-in-part of application No. 09/322,866, filed on May 28, 1989, now Pat. No. 6,145,924, which is a continuation-in-part of application No. 09/062,634, filed on Apr. 17, 1998, now Pat. No. 5,975,627, which is a continuation-in-part of application No. 08/855,031, filed on May 13, 1997, now Pat. No. 5,992,930.

(51) Int. Cl.[7] ..... A47C 1/02

(52) U.S. Cl. ..... 297/68; 297/83; 297/85; 297/452.18; 297/452.63

(58) Field of Search ..... 297/68, 83, 85

(56) References Cited

U.S. PATENT DOCUMENTS

| | | | | |
|---|---|---|---|---|
| 2,082,427 | A | 1/1937 | Sechrest | 297/452.18 |
| 2,864,438 | A | 12/1958 | Levine | 297/452.18 X |
| 3,758,151 | A | 9/1973 | Re | 297/83 |
| 4,071,275 | A | 1/1978 | Rogers, Jr. | 297/85 |
| 4,099,776 | A | 7/1978 | Crum et al. | 297/68 X |
| 4,108,491 | A | 8/1978 | Rogers, Jr. | 297/85 |
| 4,131,960 | A | 1/1979 | Quakenbush | |
| 4,185,869 | A | 1/1980 | Rogers, Jr. | 297/68 X |
| 4,188,062 | A | 2/1980 | Rogers, Jr. et al. | 297/85 |
| 4,216,991 | A | 8/1980 | Holobaugh | 297/85 |
| 4,226,469 | A | 10/1980 | Rogers, Jr. et al. | 297/85 |
| 4,244,620 | A | 1/1981 | Harrison et al. | 297/85 |
| 4,249,772 | A | 2/1981 | Rogers, Jr. | 297/85 |
| 4,291,913 | A | 9/1981 | Kowalski | 297/68 X |
| 4,306,746 | A | 12/1981 | Crum | 297/85 |
| 4,307,912 | A | 12/1981 | Watt et al. | 297/85 |
| 4,337,977 | A | 7/1982 | Rogers, Jr. et al. | 297/85 |
| 4,350,386 | A | 9/1982 | Rogers, Jr. | 297/85 |
| 4,350,387 | A | 9/1982 | Rogers, Jr. | 297/85 |
| 4,367,895 | A | 1/1983 | Pacitti et al. | 297/85 |
| 4,418,957 | A | 12/1983 | Rogers, Jr. | 297/83 |
| 4,531,778 | A | 7/1985 | Rogers, Jr. | 297/85 |
| 4,570,995 | A | 2/1986 | Rogers, Jr. | 297/68 |
| 4,577,902 | A | 3/1986 | Crum | 297/85 |
| 4,740,031 | A | 4/1988 | Rogers, Jr. | 297/85 |
| 4,805,960 | A | 2/1989 | Tacker | 297/85 |
| 4,815,788 | A | 3/1989 | May | 297/68 |
| 4,826,243 | A | 5/1989 | Lawson | 297/85 |
| 4,863,215 | A | 9/1989 | Crum | 297/85 |
| 4,878,710 | A | 11/1989 | Tacker | 297/68 |
| 4,989,914 | A | 2/1991 | Pine | 297/85 |
| 5,011,220 | A | 4/1991 | LaPointe | 297/84 X |
| 5,064,244 | A | 11/1991 | Sproule | 297/68 |
| 5,072,988 | A | 12/1991 | Plunk | 297/68 |

(List continued on next page.)

*Primary Examiner*—Peter M. Cuomo
*Assistant Examiner*—Rodney B. White
(74) *Attorney, Agent, or Firm*—Harness, Dickey & Pierce, P.L.C.

(57) ABSTRACT

A reclining chair is provided which includes a base and a support linkage assembly pivotally supported from the base. A longitudinal link is operably interconnected to the support linkage assembly. A recline linkage assembly is operably coupled to the longitudinal link and to the base for controlling movement of the longitudinal link from an upright position to at least one reclined position. An adjustable tensioning mechanism is operably coupled between the base and the support linkage to bias the chair towards a reclined position. The reclining chair further includes a leg rest assembly supported from the longitudinal link and operably coupled to the drive shaft for movement from a retracted position to an extended position in response to rotation of the drive shaft.

15 Claims, 6 Drawing Sheets

U.S. PATENT DOCUMENTS

| | | | | |
|---|---|---|---|---|
| 5,129,701 | A | 7/1992 | Pine | 297/68 |
| 5,217,276 | A | 6/1993 | LaPointe et al. | 297/85 |
| 5,292,170 | A | 3/1994 | LaPointe et al. | 297/85 |
| 5,323,526 | A | 6/1994 | Saul et al. | 297/83 X |
| RE34,666 | E | 7/1994 | Tacker | 297/85 |
| 5,346,285 | A | 9/1994 | West, III | |
| 5,360,255 | A | 11/1994 | Cook et al. | |
| 5,382,073 | A | 1/1995 | Habegger et al. | 297/85 |
| 5,423,591 | A | 6/1995 | LaPointe et al. | 297/85 X |
| 5,423,596 | A | 6/1995 | Laughlin et al. | |
| 5,427,431 | A | 6/1995 | Saul et al. | |
| 5,435,621 | A | 7/1995 | Komorowski et al. | 297/85 X |
| 5,480,209 | A | 1/1996 | May | 297/85 |
| 5,480,213 | A | 1/1996 | Sproule | |
| 5,527,092 | A | 6/1996 | Cook et al. | |
| 5,527,095 | A | 6/1996 | Marshall et al. | 297/85 X |
| 5,544,943 | A | 8/1996 | Durling | |
| 5,556,158 | A | 9/1996 | Wiecek | |
| 5,570,927 | A | 11/1996 | LaPointe et al. | 297/85 |
| 5,570,930 | A | 11/1996 | LaPointe et al. | |
| 5,588,710 | A | 12/1996 | Wiecek | 297/85 X |
| 5,678,897 | A | 10/1997 | Prestia | |
| 5,735,573 | A | 4/1998 | Vredevoogd | |
| 5,918,944 | A | 7/1999 | Dietrich | |
| 5,975,627 | A | 11/1999 | LaPointe et al. | 297/68 |
| 5,992,930 | A | 11/1999 | LaPointe et al. | 297/68 |
| 6,145,924 | A * | 11/2000 | Mero, Jr. et al. | 297/68 |

* cited by examiner

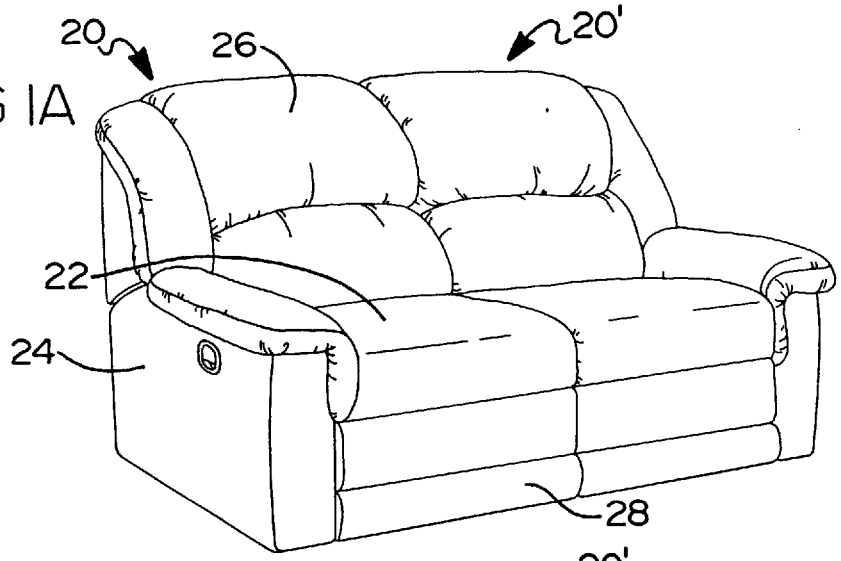
FIG IA
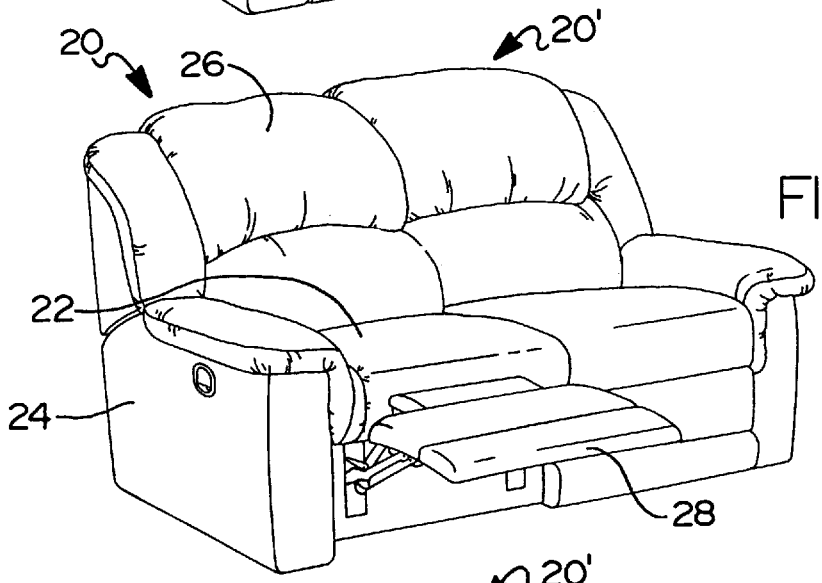
FIG IB
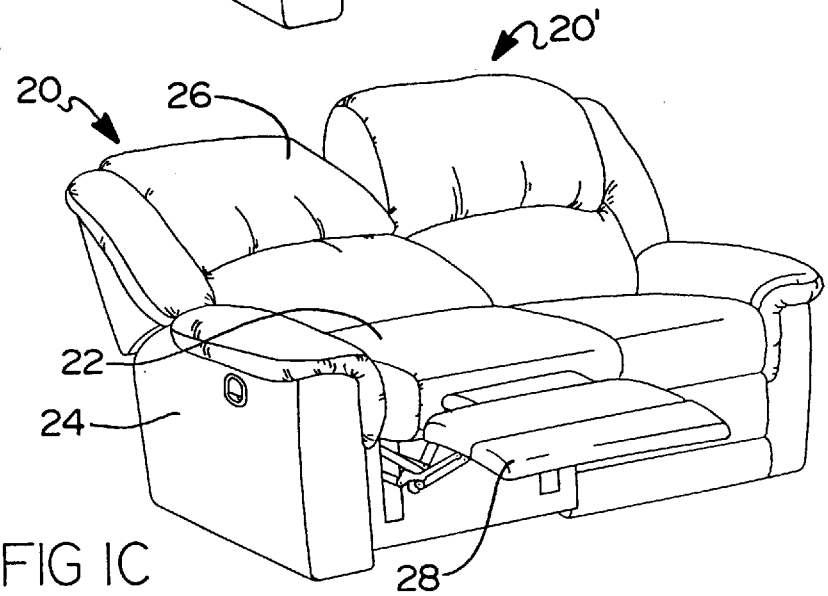
FIG IC

FIG 6
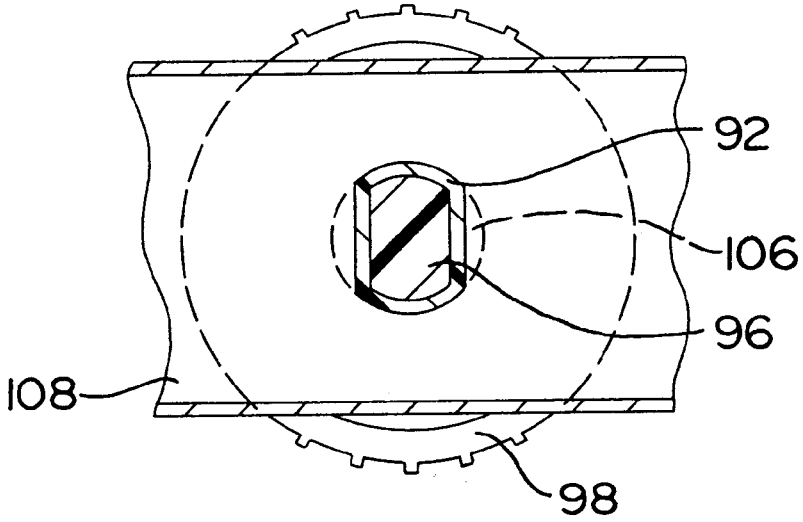
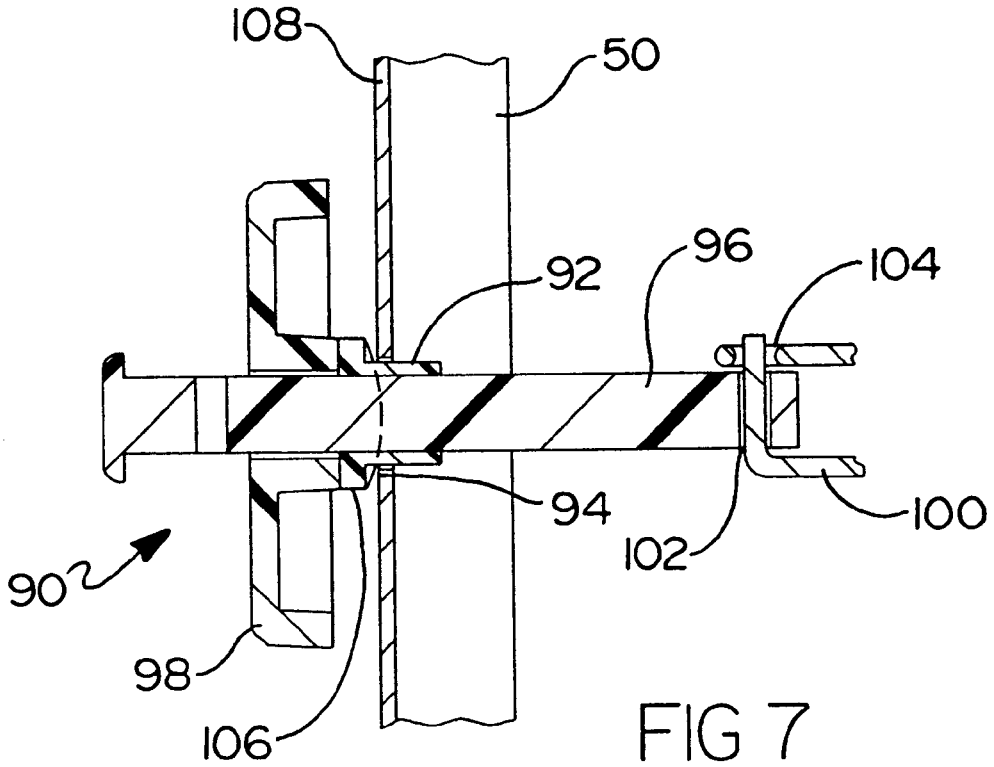
FIG 7

FIG 8
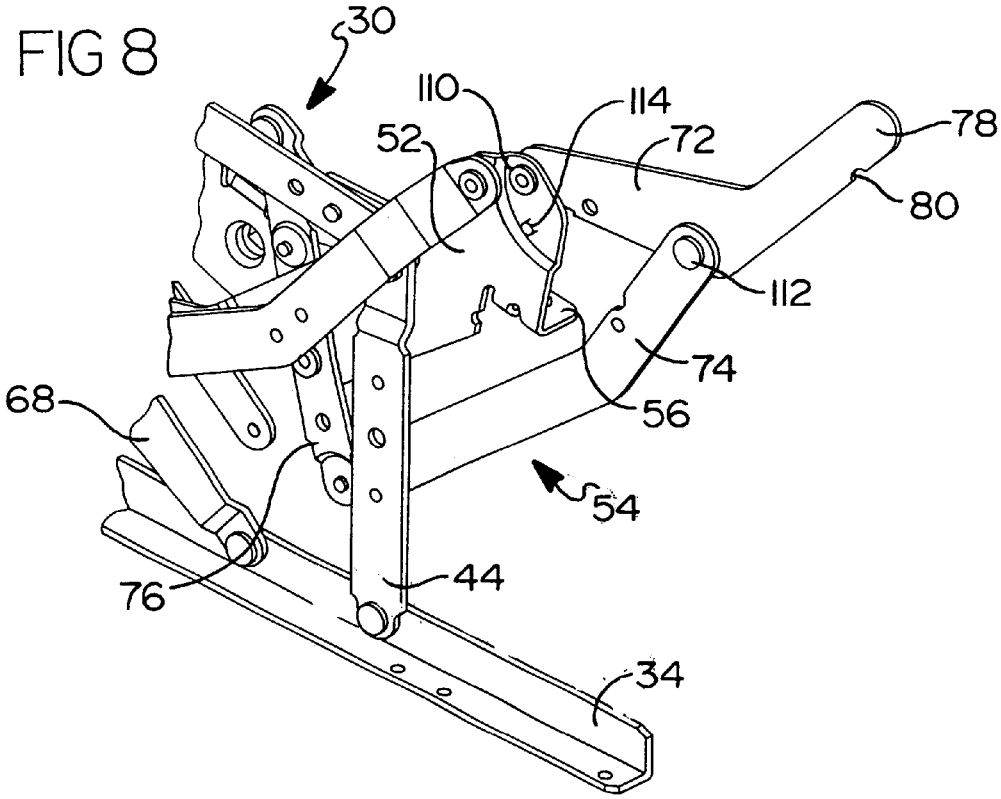
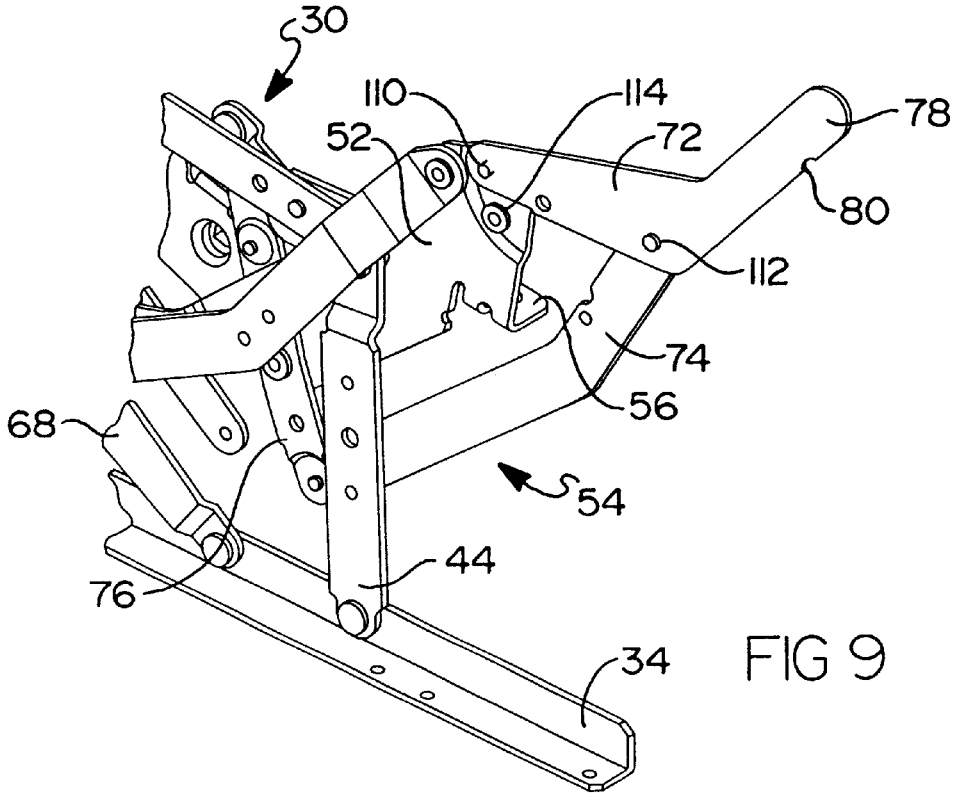
FIG 9

ALL-LINKAGE RECLINING CHAIR WITH IMPROVED TENSIONING MECHANISM

CROSS-REFERENCE TO RELATED APPLICATION

This is a continuation-in-part of U.S. application Ser. No. 09/322,866 filed May 28, 1999 now U.S. Pat. No. 6,145,924 which is a continuation-in-part of U.S. application Ser. No. 09/062,634 filed Apr. 17, 1998 now U.S. Pat. No. 5,975,627 which is a continuation-in-part of U.S. application Ser. No. 08/855,031 filed May 13, 1997 now U.S. Pat. No. 5,992,930.

BACKGROUND OF THE INVENTION

1. Technical Field

The present invention relates generally to an all-linkage wall proximity reclining mechanism for a chair and more particularly to a tensioning mechanism for adjusting the effort associated with the reclining motion.

2. Description of Related Art

Wall proximity reclining chairs are known within the art, and are becoming increasingly popular as it becomes more desirable to integrate comfort and reclining functions into various articles and styles of furniture including chairs, love seats and sofas. Many of the first developed designs were based upon all-linkage mechanisms. However, these all-linkage mechanisms typically did not provide a smooth reclining motion. To overcome this problem, wall proximity reclining mechanisms utilizing track and roller assemblies were developed to provide a smoother reclining motion. Presently, the reclining mechanisms utilizing track and rollers are relatively complex and are thus expensive to manufacture.

An exemplary track and roller reclining chair mechanism which was developed to provide a smoother reclining motion is that disclosed in U.S. Pat. No. 5,011,220, entitled "Chair Mechanism," which is expressly incorporated herein by reference, and which is commonly owned by the assignee of the present invention. This mechanism utilizes a short inclined track and roller to provide the reclining motion of the wall proximity reclining chair. While this chair mechanism achieved the goal of providing smoother reclining operation, the design of this mechanism presents several disadvantages. First, this mechanism is limited to only two operative positions, namely the upright position, and the fully-reclined position. Additionally, this chair design does not allow the chair arms to move along with the seat assembly. Thus, this chair design requires a chair frame having more forwardly extending arm rests for providing adequate support when the chair mechanism is in the fully reclined position.

Another exemplary wall proximity reclining chair is that disclosed in U.S. Pat. No. 5,217,276, entitled "Chair Mechanism," which is also expressly incorporated herein by reference, and which is commonly owned by the assignee of the present invention. This chair mechanism design provides several improvements over those mechanisms known within the art. However, this mechanism also relies upon a track and roller system for providing smooth reclining motion. Additionally, this chair is limited to only two reclining positions, and requires manual actuation via a hand operated lever. Accordingly, this design limits the types of furniture within which this mechanism can be integrated.

Yet another type of wall proximity reclining chair is that illustrated in U.S. Pat. No. 5,323,526, entitled "Method for Assembling A Modular Wall Proximity Reclining Chair," which is expressly incorporated herein by reference, and which is commonly owned by the assignee of the present invention. This chair was developed for reducing the complexity of the reclining mechanism, and the method for assembling the reclining mechanism. This chair mechanism surmounted the disadvantages of the prior art designs by providing a side frame and arm rest assembly that moves in conjunction with the seat assembly for providing adequate arm rest support. However, this mechanism design also relies upon a full length track and roller assembly for providing the desired smoothness in the reclining operation. The requirement for a bearing based roller assembly also increases the cost of the mechanism. Additionally, the design of this mechanism limits this chair to a single reclining chair and further prevents this mechanism from being used in larger articles of furniture, such as loveseats, sofas and modular sofa assemblies.

The all-linkage reclining chair mechanisms known within the art also do not provide adequate adjustment features for accommodating seat occupants of varying stature. In view of the growing popularity of wall proximity chairs, there is a increasing need to develop a wall proximity reclining chair mechanism which can be utilized with various types of furniture at a considerably lower cost and that provides the comfort features demanded by consumers. As such, it is desirable to provide an all-linkage wall proximity reclining chair which delivers smooth reclining motion and includes an adjustment feature for accommodating various sized seat occupants. It is also desirable to provide an all-linkage reclining chair mechanism which is designed to be primarily gravity driven with the assistance of a spring biasing mechanism, rather than manually driven by the occupant using an externally mounted operating handle. Such a design would simplify the operation of the chair. It is further desirable to provide an all-linkage reclining chair mechanism adaptable for use in a wide variety of motion furniture such as chairs, love seats and sofas. It is also desirable to provide a wall proximity reclining chair mechanism in which the leg rest assembly can be fully extended by actuating a compact trigger release assembly, and can be retracted by the occupant merely moving the leg rest assembly back into the chair mechanism by leaning forward and placing a small amount of force onto the leg rest assembly. Finally, it is desirable to provide a reclining mechanism in which the leg rest assembly can be replaced in the field, if damaged during use, without disassembling the entire chair mechanism.

SUMMARY OF THE INVENTION

In accordance with the principles of the present invention, an all-linkage wall proximity reclining chair is disclosed which can be readily incorporated into several different types of furniture. The reclining chair includes a base, and a support linkage assembly pivotally supported from the base. A longitudinal link is operably interconnected to the support linkage assembly. A recline linkage assembly is operably coupled to the longitudinal link and to the base for controlling movement of the longitudinal link from an upright position to at least one reclined position. A rotatable drive shaft is journally supported by the longitudinal link. The reclining chair further includes a leg rest assembly supported from the longitudinal link and operably coupled to the drive shaft for movement from a retracted position to an extended position in response to rotation of the drive shaft. A tensioning mechanism is operably disposed between the base and the support linkage for biasing the longitudinal link toward the reclined position. The tensioning mechanism is adjustable for varying the biasing force associated therewith.

Additional objects, advantages and features of the present invention will become apparent from the following description and appended claims, taken in conjunction with the accompanying drawings.

DESCRIPTION OF THE DRAWINGS

FIGS. 1A through 1C are perspective views of an exemplary wall proximity recliner showing the various operative positions, including an upright position with the leg rest assembly retracted, a partially reclined position with the leg rest assembly fully extended, and a fully reclined position with the leg rest assembly extended and the seat back fully reclined;

FIG. 6 is a cross-section taken along line VI—VI illustrated in FIG. 5;

FIG. 7 is a cross-section taken along line VII—VII illustrated in FIG. 4;

FIG. 8 is a partial perspective view of the all-linkage mechanism illustrating the seat back attachment bracket in a first configuration; and FIG. 9 is a partial perspective view of the all-linkage mechanism illustrating the seat back attachment bracket in a second configuration.

DETAILED DESCRIPTION OF THE INVENTION

Figure 2:
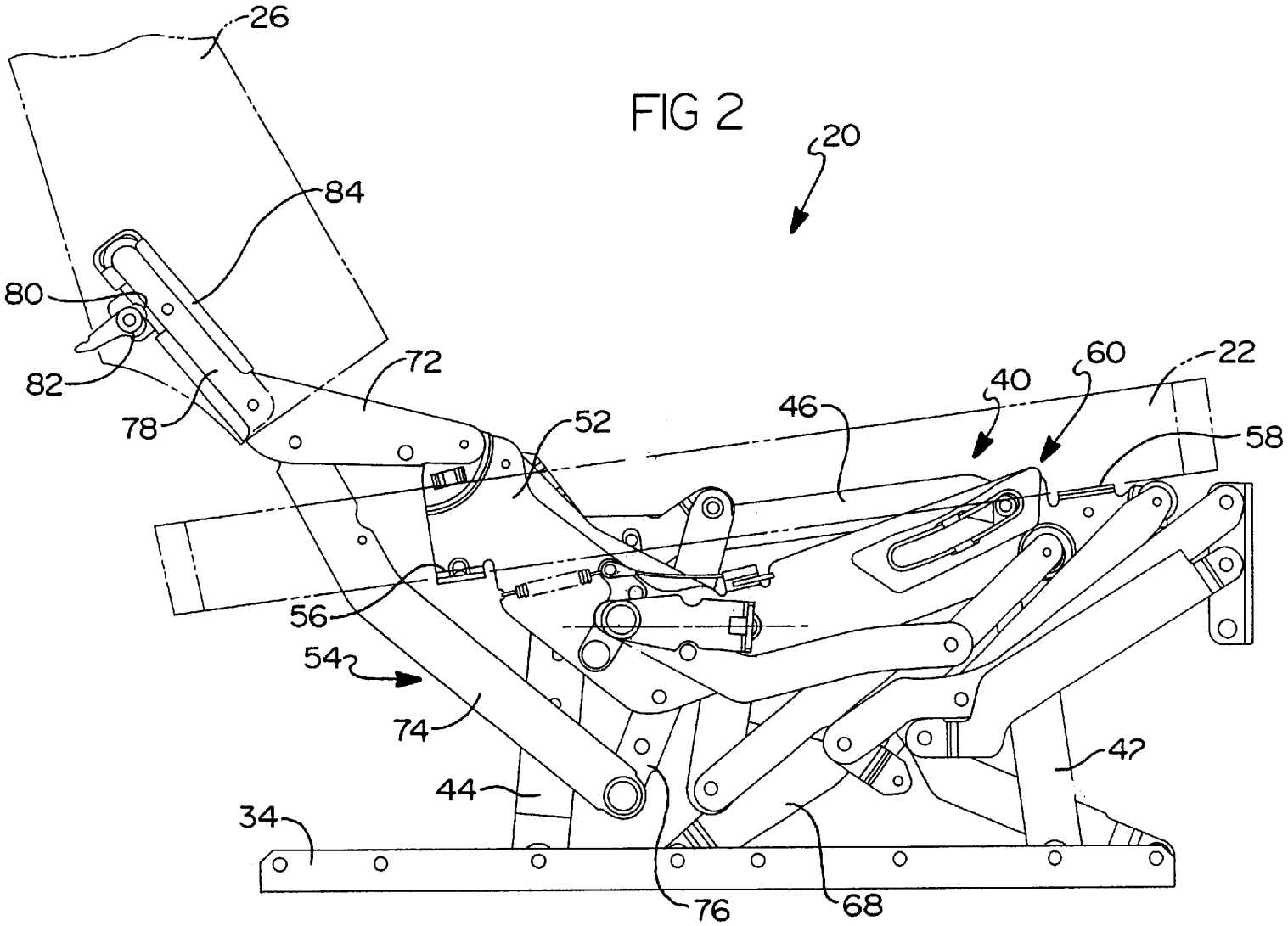
FIG. 2 is an outside elevational view of an all-linkage mechanism in accordance with a preferred embodiment of the present invention with the upholstery, springs and other parts removed from the reclining mechanism for illustrating the integrated and inter-dependent association of the linkage components.

In accordance with the teachings of the present invention, an all-linkage wall proximity recliner adapted for use in various articles of motion furniture is disclosed. In a preferred embodiment, a pair of all-linkage recliners 20, 20' are intergrated into a love seat in which the recliners 20, 20 ' independently recline. However, it should be understood that the all-linkage mechanisms of the present invention, can be incorporated into a variety of motion furniture designs. With particular reference now to the drawings, the structural and functional aspects of the present invention are described with more particular detail.

With reference now to FIGS. 1A through 1C, wall proximity reclining chair 20 includes a seat frame 22 having an arm rest or side frame 24, and further includes a reclinable seat back 26 and movable leg rest assembly 28. FIG. 1A illustrates wall proximity reclining chair 20 in its upright position, with leg rest assembly 28 retracted within the chair. FIG. 1B illustrates the wall proximity reclining chair 20 in its partially reclined or intermediate position, in which leg rest assembly 28 is fully extended and seat back 26 is partially reclined. Leg rest assembly 28 is positionable between a retracted position shown in FIG. 1A and an extended position as shown in FIGS. 1B and 1C. FIG. 1B further illustrates the wall proximity feature in that seat frame 22, side frame 24, and seat back 26 move forwardly along with leg rest assembly 28 when the wall proximity reclining chair 20 is moved from its upright position to its partially reclined position. Finally, FIG. 1C illustrates wall proximity reclining chair 20 in its fully reclined position. It should be noted that leg rest assembly 28 must be fully extended before seat back 26 can begin reclining. As will be appreciated from FIG. 1C and the following detailed description, when wall proximity reclining chair 20 is in the partially reclined position, additional rearward pressure placed against seat back 26 by the occupant, correspondingly forces the seat frame 22, side frame 24 and leg rest assembly 28 forward. Accordingly, the all-linkage mechanism is designed to allow seat back 26 to be placed within approximately 5–6 inches (12–15 cm) of a wall surface and achieve a fully reclined position without seat back 26 making contact with the proximal wall surface.

Figure 3:
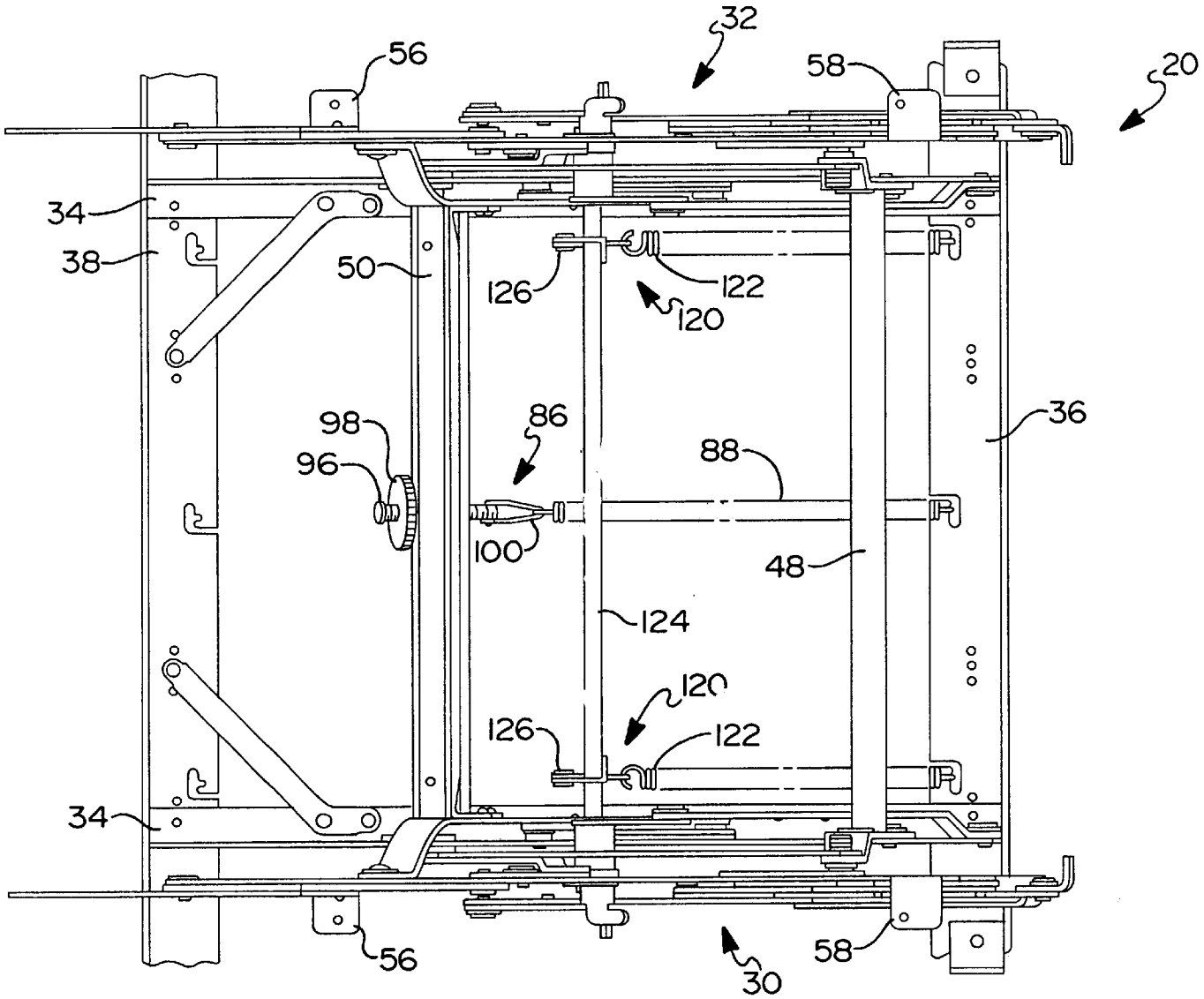
FIG. 3 is a top plan view showing the all-linkage mechanism interconnected with various cross members and the adjustable tensioning mechanism in accordance with a preferred embodiment of the present invention.

Referring now to FIGS. 2 and 3, the preferred embodiment of the present invention is illustrated in more detail. Wall proximity reclining chair 20 includes right and left all-linkage mechanisms 30, 32. It should be understood that the all-linkage mechanisms 30, 32 are mirror images of each other. Each all-linkage mechanism 30, 32 is pivotably secured to a longitudinal "L-shaped" base rail 34. Referring briefly to FIG. 3, the pair of longitudinal base rails 34 are then secured to front and rear "L-shaped" frame rails 36, 38.

Referring again to FIGS. 2 and 3, the individual components forming each all-linkage mechanism are described in more detail. Each all-linkage mechanism 30, 32 is generally supported from its longitudinal base rail 34 by a four-bar linkage assembly 40. More specifically, the four-bar linkage assembly 40 includes a front support link 42 and a rear support link 44 which are pivotably coupled at their lower ends to the vertical flange of the longitudinal base rail 34. Additionally, the front support link 42 and the rear support link 44 are pivotably coupled at their upper ends to the secondary longitudinal or intermediate link 46. The right and left all-linkage mechanisms 30, 32 are interconnected to each other by a front cross member 48 which connects between the front support links 42, and a rear cross member 50 which connects between the rear support links 44.

The prominent link of each all-linkage mechanism 30, 32 is the main longitudinal link 52 which supports the seat frame 22 and side frame or frames 24. The forward end of main longitudinal link 52 is directly supported by the front support link 42, and the rearward end of longitudinal link 52 is indirectly supported by the recline linkage assembly 54. The main longitudinal link 52 further includes front and rear flanges 56, 58 which protrude outwardly from the main longitudinal link 52 for supporting and securing the seat frame 22 and side frame 24.

The adjustable seat slide 60 controls how easily the main longitudinal link 52 can move with respect to front support link 42. Thus, the adjustable seat slide 60 controls the amount of friction between longitudinal link 52 and support link 42 during the reclining motion. Each all-linkage mechanism 30, 32 further includes a recline linkage assembly 54 which is defined by a first position recline linkage 62, and a second position recline linkage 64. The first position recline linkage 62 includes a first connecting link 66, a base connecting link 68 and a second connecting link 70. The primary function of the first position recline linkage 62 is to control the forward motion of the four-bar linkage 40 supporting the main longitudinal link 52 as the chair 20 reclines away from the wall surface into the intermediate position.

The second position recline linkage 64 includes a seat back support link 72, a recline connecting link 74, and a vertical pivoting drive link 76. The primary function of the second position recline linkage 64 is to control the forward motion of the main longitudinal link 52 from the intermediate position to the fully reclined position, and to control the reclining motion of the seat back 26. The upstanding portion 78 of the seat back supporting link 72 includes a rearward facing notch 80 for receiving the locking cam mechanism 82 of the seat back connecting bracket 84. The seat back connecting bracket 84 is secured to the upright side frame member of the detachable seat back 26 with suitable fasteners. A more detailed description of the components associated with the seat back connecting bracket 84 can be found in U.S. Pat. No. 5,184,871, entitled "Detachable Chair Back," which is expressly incorporated herein by reference, and which is commonly owned by the Assignee of the present invention.

With reference now to FIGS. 3–7, the wall proximity reclining chair 20 is also provided with an adjustable drive spring assembly 86 which provides a forward bias to the four-bar linkage 40, and assists in the reclining of the chair 20. Adjustable drive spring assembly 86 includes spring member 88 operably coupled between front frame rail 36 and rear cross member 50. Tensioning mechanism 90 is supported by rear cross member 50 and connects to the rear end of spring member 88. Tensioning mechanism 90 includes bushing 92 inserted within an aperture 94 formed in rear cross member 50 and rotatably supports threaded stud 96. Adjusting wheel 98 is threadingly received on stud 96 and cooperates with bushing 92 for selectively adjusting the length of tensioning mechanism 90. An aperture 100 formed through threaded stud 96 on an end opposite adjusting wheel 98 receives a retaining clip 102 for operably coupling spring member 88 to tensioning mechanism 90. A retaining washer 104 is used on clip 102 for preventing uncoupling of tensioning mechanism 90 from spring 88.

Adjustable drive spring assembly 86 is operable to increase or decrease, and thereby adjust, the preload in spring member 88 for providing a forward bias to the four-bar linkage 40. More specifically, by adjusting the effective length of tensioning mechanism 90 between rear cross rail 50 and spring member 88, the preload may be adjusted. To this end, wheel 98 is provided with a set of female threads which are complementary to the male threads formed on threaded stud 96. As presently preferred, a suitable power transfer thread configuration such as an Acme thread is utilized to provide adequate mechanical advantage while minimizing the number of turns required to adjust the effective length of tensioning mechanism 90. For example, an Acme thread having a pitch of eight (8) threads per inch is presently preferred.

Figure 4:
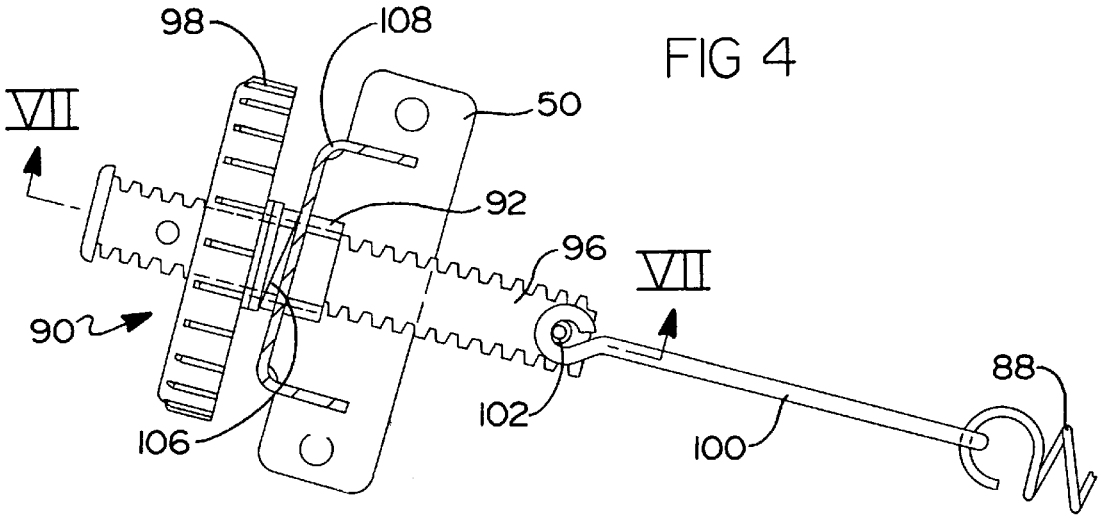
FIG. 4 is a partial cross-sectional view of the all-linkage mechanism in an upright position and further illustrating the adjustable tensioning mechanism in accordance with a preferred embodiment of the present invention.
Figure 5:
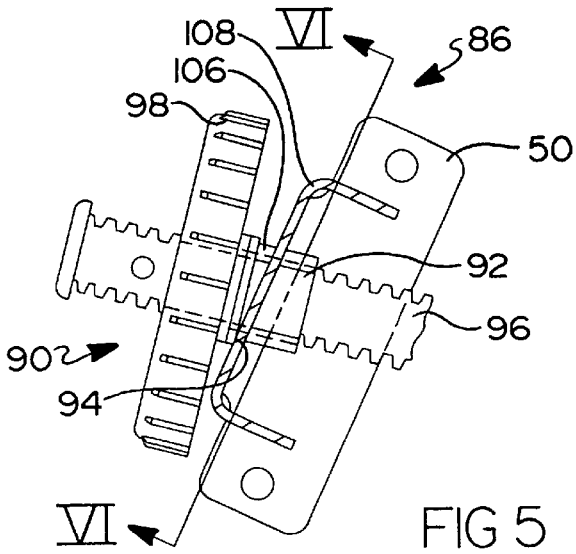
FIG. 5 is a partial cross-sectional view similar to FIG. 4 showing the all-linkage mechanism in a reclined position.

As best seen in FIG. 6, bushing 92 and stud 96 are provided with flat side walls which are complementary to aperture 94 formed through cross member 50 to prevent rotation of bushing 92 and stud 96 upon rotation of wheel 98. In addition, bushing 92 is provided with a tapered shoulder 106 which engages a rear surface of the web 108 formed on cross member 50. As seen in FIG. 4, only the thick portion of shoulder 106 formed on bushing 92 engages web 108 when the reclining chair is in an upright position. In this orientation, adjusting wheel 98 is substantially parallel with the web 108 of rear cross member 50. As the reclining chair moves to a reclined position, cross member 50 rotates downwardly off vertical. As a result, bushing 92 rotates within aperture 94 such that the entire length of shoulder 106 engages web 108. Adjusting wheel 98 takes on an angular orientation with respect to web 108, shoulder 102 functions to maintain adequate spacing between adjusting wheel 98 and web 108 to provide free manipulation thereof.

Turning now to FIGS. 8 and 9, yet another aspect of the present invention is illustrated which provides additional flexibility and adaptability of the all-linkage reclining mechanism for use in various furniture configurations. More specifically, seat back support link 72 may be operably coupled to main longitudinal link 52 and recline connecting link 74 in a manner to significantly adjust the seat back width accommodated thereby. For example, as illustrated in FIG. 8, seat back support link 72 may be pivotally coupled on an outboard side of main longitudinal link 52 and recline connecting link 74 by threaded rivets 110 and 112, respectively. With reference now to FIG. 9, seat back support link 72 may also be positioned in an alternate configuration for accommodating a relatively narrow seat back. More specifically, by locating seat back support link 72 on the inboard side of main longitudinal link 52 the distance between left and right upstanding portions 78 may accommodate a more narrow seat back frame. Seat back support link 72 is pivotally coupled to an inboard side of main longitudinal link 52 and recline connecting link 74 by threaded rivets 110, 112, respectively. To further enhance the adaptability of all-linkage reclining mechanism 30, a threaded rivet stop 114 may be utilized on either the outboard side of main longitudinal link 52 as illustrated in FIG. 8 or the inboard side of main longitudinal link 52 as illustrated in FIG. 9. Stop 114 limits the movement of seat back support link 72.

With continued reference to FIGS. 2 and 3, in view of FIGS. 1A through 1C, the functional operation of wall proximity reclining chair 20 is described in general detail. A more specific description of the functional operation of the wall proximity chair 20, as well as additional detail regarding the components not fully described herein can be found in U.S. Pat. Nos. 5,992,930, 5,975,627, and U.S. application Ser. No. 09/322,866, all of which are commonly owned by the assignee of the present invention and the disclosures of which are expressly incorporated by reference herein. Each all-linkage mechanism 30, 32 is maintained in its upright position by spring assist drive linkage 120. More specifically, the biasing spring 122 operably coupled between front frame rail 36 and square drive rod 124 forces drive rod 124 into its retracted position through over-center mechanism 126, thereby locking the reclining chair 20 in the upright position.

Upon initiating a trip link assembly, the leg rest assembly 28 begins to extend, and the main longitudinal link 52 moves forwardly via the front and rear support links 42, 44. Adjustable drive spring assembly 86 functions to bias all-linkage mechanisms 30, 32 towards the reclined position. The effect of that biasing force is adjustable to accommodate seated occupants of widely varying weight, strength and stature. As the main longitudinal link 52 moves forwardly into the partially reclined position, the rear portion of the main longitudinal link 52 moves forwardly and downwardly as the tripartite linkage formed by the rear support link 44, first connecting link 66, base connecting link 68, and second connecting link 70, rotates downwardly to contact the horizontal flange of the longitudinal base rail 34. Eventually, the tripartite linkage assembly, and especially the base connecting link 68, bottoms out against the longitudinal base rail 34. The mechanism is designed so that the leg rest assembly 28 is fully extended when the base connecting link 68 contacts the base rail 34. The forward and downward motion of the rear portion of the main longitudinal link 52 causes the seat back 26 to also move downwardly and to be tipped rearwardly through the seat back support link 72 and recline connecting link 74.

The second recline phase is initiated by rearward and downward pressure on the seat back 26, which rotates the seat back support link 72 downwardly with respect to the main longitudinal link 52. The recline connecting link 74 is then driven forwardly. The forward driving motion of the recline connecting link 74 causes the vertical pivoting drive link 76 to rotate in a counter clockwise direction about a middle pivot with the lower portion of the main longitudinal link 52. Accordingly, the force provided by the seat occupant leaning back into seat back 26 provides the requisite leveraging force through the second position recline linkage 64 to the recline connecting link 74 and the vertical pivoting drive link 76 to forwardly drive the main longitudinal link 52 with respect to the adjustable seat slide 60. The second position recline linkage 64 and the adjustable seat slide 60 further allow the seat occupant to achieve an infinite number of positions within the range of motion provided by the lost motion slot.

The front and rear support links 42, 44 remain completely stationary while the main longitudinal link 52 is driven forwardly and upwardly via the front seat slide 60 and second position recline linkage 64 when the all-linkage mechanism 30, 32 is fully reclined. Additionally, the first connecting link 66 and base connecting link 68 of the tripartite linkage assembly also remain stationary during the second recline phase.

The chair 20 is moved from the fully reclined position to the intermediate position by the seat occupant leaning forward so that the main longitudinal link 52 slides rearwardly about front seat slide 60 and second position recline linkage 64. Once in this position, the leg rest assembly 28 can be retracted by the seat occupant to move and lock the reclining mechanisms 30, 32 into the upright position. This is accomplished by the seat occupant placing downward and rearward pressure on the leg rest assembly 28, which causes the leg rest assembly 28 to retract and the chair 20 to move from the intermediate position to the upright position. When the leg rest assembly 28 is fully retracted, the outboard drive link 160 is moved into its over center position, thereby locking the all-linkage mechanisms 30, 32 into the upright position. Extension of the leg rest assembly 28 can then be initiated by activating the trip link assembly 234.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A reclining mechanism comprising:

a base frame;

a support linkage assembly including a first support linkage pivotally coupled to said base frame, a second support link pivotally coupled to said base frame, and an intermediate link pivotally coupled to said first support linkage at a first pivot and pivotally coupled to said second support link at a second pivot;

an adjustable drive spring assembly operably disposed between said base frame and said first support linkage to forwardly bias said support linkage assembly, said drive spring assembly including a spring member having a first end connected to said base frame and a second end operably coupled to said second support link and a tension adjusting mechanism for adjusting the tension in said spring.

2. The reclining mechanism of claim 1 wherein said tension adjusting mechanism comprises a threaded stud operably connected to said second support link and positionable relative to said base frame for adjusting the tension in said spring.

3. The reclining mechanism of claim 2 wherein said threaded stud has a thread pitch of approximately eight threads per inch.

4. The reclining mechanism of claim 2 wherein said tension adjusting mechanism further comprises a retaining clip having a first end secured to said spring and a second end pivotally coupled to said threaded stud.

5. The reclining mechanism of claim 2 wherein said tension adjusting mechanism further comprise a bushing slidably receiving said threaded stud and an adjustment wheel engaging said threaded stud such that rotation of said adjustment wheel positions said threaded stud relative to said base frame.

6. The reclining mechanism of claim 5 wherein said bushing has a shoulder formed thereon to maintaining a spaced relationship between said second support linkage and said adjustment wheel.

7. The reclining mechanism of claim 6 wherein said shoulder has a tapered profile.

8. The reclining mechanism of claim 5 wherein said bushing has a collar portion having non-circular cross-section which engages said second support linkage to prevent relative rotation therebetween.

9. A reclining mechanism comprising:

a base frame having a pair of longitudinal base rails and a cross rail;

a support linkage assembly having an intermediate link, a first support linkage including a pair of first support links pivotally coupled at a first end to said pair of longitudinal base rails and pivotally coupled to said intermediate link at a second end, and a second support linkage including a pair of second support links interconnected by a cross member, said pair of second support links pivotally coupled at a first end to said pair of longitudinal base rails and pivotally coupled to said intermediate link at a second end; and an adjustable drive spring assembly including a tension adjusting mechanism supported by said cross member of said second support linkage and positionable relative to said cross rail and a spring member having a first end connected to said cross rail of said base frame and a second end operably coupled said tension adjusting mechanism such tension in said spring may be selective set.

10. The reclining mechanism of claim 9 wherein said tension adjusting mechanism further comprise a bushing disposed in an aperture formed through said cross member, a threaded stud slidably received within said bushing, and an adjustment wheel engaging said threaded stud such that rotation of said adjustment wheel positions said threaded stud within said bushing.

11. The reclining mechanism of claim 10 wherein said threaded stud has a thread pitch of approximately eight threads per inch.

12. The reclining mechanism of claim 10 wherein said tension adjusting mechanism further comprises a retaining clip having a first end secured to said spring and a second end pivotally coupled to said threaded stud.

13. The reclining mechanism of claim 10 wherein said bushing has a shoulder formed thereon to maintaining a spaced relationship between said cross member and said adjustment wheel.

14. The reclining mechanism of claim 13 wherein said shoulder has a tapered profile.

15. The reclining mechanism of claim 10 wherein said bushing has a collar portion having non-circular cross-section and said aperture formed through said cross member has a complementary non-circular cross-section to prevent relative rotation therebetween.

* * * * *

UNITED STATES PATENT AND TRADEMARK OFFICE

CERTIFICATE OF CORRECTION

PATENT NO. : 6,409,262 B1
DATED : June 25, 2002
INVENTOR(S) : Larry P. LaPointe

It is certified that error appears in the above-identified patent and that said Letters Patent is hereby corrected as shown below:

Title page,
Item [63], Related U.S. Application Data, "1989" should be -- 1999 --;

Column 2,
Line 20, "a" should be -- an --;

Column 3,
Line 49, "intergrated" should be -- integrated --;
Line 49, "20, 20" should be -- 20,20 --;

Column 8,
Line 12, "maintaining" should be -- maintain --;
Line 39, "coupled" insert -- to --;
Line 40, "selective" should be -- selectively --;
Line 43, "comprise" should be -- comprises --;
Line 56, "maintaining" should be -- maintain --.

Signed and Sealed this

Thirteenth Day of May, 2003

JAMES E. ROGAN
*Director of the United States Patent and Trademark Office*